US007651004B2

(12) United States Patent
Fuchs

(10) Patent No.: US 7,651,004 B2
(45) Date of Patent: Jan. 26, 2010

(54) LINERLESS CLOSURE AND PACKAGE

(75) Inventor: Timothy J. Fuchs, Perrysburg, OH (US)

(73) Assignee: Rexam Closure Systems Inc., Perrysburg, OH (US)

( * ) Notice: Subject to any disclaimer, the term of this patent is extended or adjusted under 35 U.S.C. 154(b) by 306 days.

(21) Appl. No.: 11/129,236

(22) Filed: May 12, 2005

(65) Prior Publication Data

US 2006/0255003 A1 Nov. 16, 2006

(51) Int. Cl.
*B65D 41/34* (2006.01)
*B65D 53/00* (2006.01)

(52) U.S. Cl. ..... 215/344; 215/DIG. 1

(58) Field of Classification Search ..... 215/329, 215/343, 344, DIG. 1
See application file for complete search history.

(56) References Cited

U.S. PATENT DOCUMENTS 3,055,526 A * 9/1962 Plunkett ..... 215/329
3,203,571 A 8/1965 Plunkett
3,360,149 A 12/1967 Roth
3,441,161 A 4/1969 Van Baarn
3,455,500 A * 7/1969 Wilcox ..... 229/125.17
3,632,005 A * 1/1972 Kessler ..... 215/344
3,747,792 A 7/1973 Anthony
4,016,996 A * 4/1977 Aichinger et al. ..... 215/344
4,090,631 A * 5/1978 Grussen ..... 215/329
4,143,785 A 3/1979 Ferrell
4,210,251 A * 7/1980 Grussen ..... 215/329
4,442,947 A * 4/1984 Banich, Sr. ..... 215/344
4,489,845 A * 12/1984 Aichinger et al. ..... 215/329
4,560,077 A 12/1985 Dutt
4,907,709 A * 3/1990 Abe et al. ..... 215/252
5,133,471 A 7/1992 Pujol Almirall
5,161,707 A * 11/1992 Dutt et al. ..... 215/344
5,297,688 A * 3/1994 Beck et al. ..... 215/344
5,450,973 A 9/1995 Ellis et al.
5,487,481 A 1/1996 Sander et al.
5,738,231 A 4/1998 Montgomery
5,803,286 A 9/1998 Pfefferkorn et al.
6,126,027 A 10/2000 Thompson
6,338,414 B1 1/2002 Schellenbach
6,491,175 B1 12/2002 Taha (Continued)

FOREIGN PATENT DOCUMENTS

CH 564461 7/1975

(Continued)

*Primary Examiner*—Anthony Stashick
*Assistant Examiner*—James N Smalley
(74) *Attorney, Agent, or Firm*—Reising Ethington PC

(57) ABSTRACT

A linerless closure of one-piece integrally molded plastic construction includes a base wall and a cylindrical skirt for attaching the closure to a container neck finish. First and second circumferentially continuous annular walls extend from the base wall at positions radially inward from the skirt. The first and second annular walls are spaced from each other to receive an end portion of the container neck finish when the closure is applied to the neck finish. At least one of the annular walls has a circumferentially continuous annular projection extending toward the opposing annular wall. The annular projection is axially flexible for bending and folding toward the base wall and toward the at least one annular wall in sealing engagement with the end portion of the container neck finish when such end portion is received between the annular walls.

19 Claims, 3 Drawing Sheets

U.S. PATENT DOCUMENTS

| | | | | |
|---|---|---|---|---|
| 6,626,310 | B2 | 9/2003 | Taha | |
| 6,640,988 | B2 | 11/2003 | Taha | |
| 6,695,161 | B2 | 2/2004 | Kano et al. | |
| 6,702,134 | B2 * | 3/2004 | Scalese et al. | 215/344 |
| 6,779,672 | B2 | 8/2004 | Kano et al. | |
| 7,014,055 | B2 * | 3/2006 | Kano et al. | 215/344 |
| 2001/0027957 | A1 | 10/2001 | Kano | |
| 2002/0000420 | A1 | 1/2002 | Taha | |
| 2002/0158037 | A1 | 10/2002 | Kano et al. | |
| 2003/0015490 | A1 | 1/2003 | Taha | |
| 2004/0060893 | A1 | 4/2004 | Kano et al. | |
| 2004/0104193 | A1 | 6/2004 | Yashima et al. | |
| 2004/0188375 | A1 | 9/2004 | Camacho-Paredes | |

FOREIGN PATENT DOCUMENTS

| | | | |
|---|---|---|---|
| DE | 19705717 | A1 | 8/1998 |
| EP | 1327508 | A1 | 7/2003 |
| GB | 1289508 | | 9/1972 |
| GB | 2068913 | | 8/1981 |
| GB | 2120219 | | 11/1983 |
| GB | 2131774 | | 6/1984 |
| GB | 2133394 | | 7/1984 |

* cited by examiner

LINERLESS CLOSURE AND PACKAGE

The present disclosure relates to linerless closures, and to pressurized packages containing such closures.

BACKGROUND AND SUMMARY OF THE DISCLOSURE

It is conventional in the packaging field to provide pressurized closure and container packages, such as cold soft drink packages, having a flexible resilient liner for sealing engagement with at least one sealing surface on the container neck finish. Linerless closures have been proposed for non-pressurized packages to eliminate the expense of providing a sealing liner on the closure. However, linerless closures have not been as successful as desired in pressurized package applications, ranging from bottled water packages having an internal pressure of about 10 psi to cold soft drink packages having an internal pressure of about 75 psi at room temperature. Difficulties are encountered in manufacturing the closure with sufficient accuracy to maintain sealing contact with the container neck finish, particularly in applications involving molded plastic containers. It is a general object of the present disclosure to provide a linerless closure, and to provide a package embodying such a closure, that is adapted to achieve and maintain sealing engagement with the container neck finish in pressurized package applications over normal manufacturing tolerance variations on the closure and the container neck finish.

The present disclosure embodies a number of aspects that can be implemented separately from or in combination with each other.

A linerless closure of one-piece integrally molded plastic construction, in accordance with one aspect of the present disclosure, includes a base wall and a cylindrical skirt for attaching the closure to a container neck finish. First and second circumferentially continuous annular walls extend from the base wall at positions radially inward from the skirt. The first and second annular walls are spaced from each other to receive an end portion of the container neck finish when the closure is applied to the neck finish. At least one of the annular walls has a circumferentially continuous annular projection extending toward the opposing annular wall. The annular projection is axially flexible for bending and folding toward the base wall and toward the at least one annular wall in sealing engagement with the end portion of the container neck finish when such end portion is received between the annular walls.

In exemplary preferred embodiments of the disclosure, the base wall has a central portion with a first thickness, a first peripheral portion contiguous with the central portion and having a second thickness greater than the first thickness, and a second peripheral portion between the first peripheral portion and the skirt and having a third thickness greater than the second thickness. The first annular wall extends from the base wall at a juncture of the central and first peripheral portions of the base wall. The second annular wall extends from the base wall at a juncture of the first and second peripheral portions of the base wall. In some preferred embodiments of the disclosure, both of the annular walls have circumferentially continuous axially flexible annular projections that extend toward the opposing wall, most preferably in radial alignment with each other. In another preferred embodiment of the disclosure, the radially inner annular wall is contoured for plug-sealing engagement with the inside surface of the container neck finish when the closure is attached to the container neck finish. In the exemplary preferred embodiments of the disclosure, the annular projections are wedge-shaped in radial cross section.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
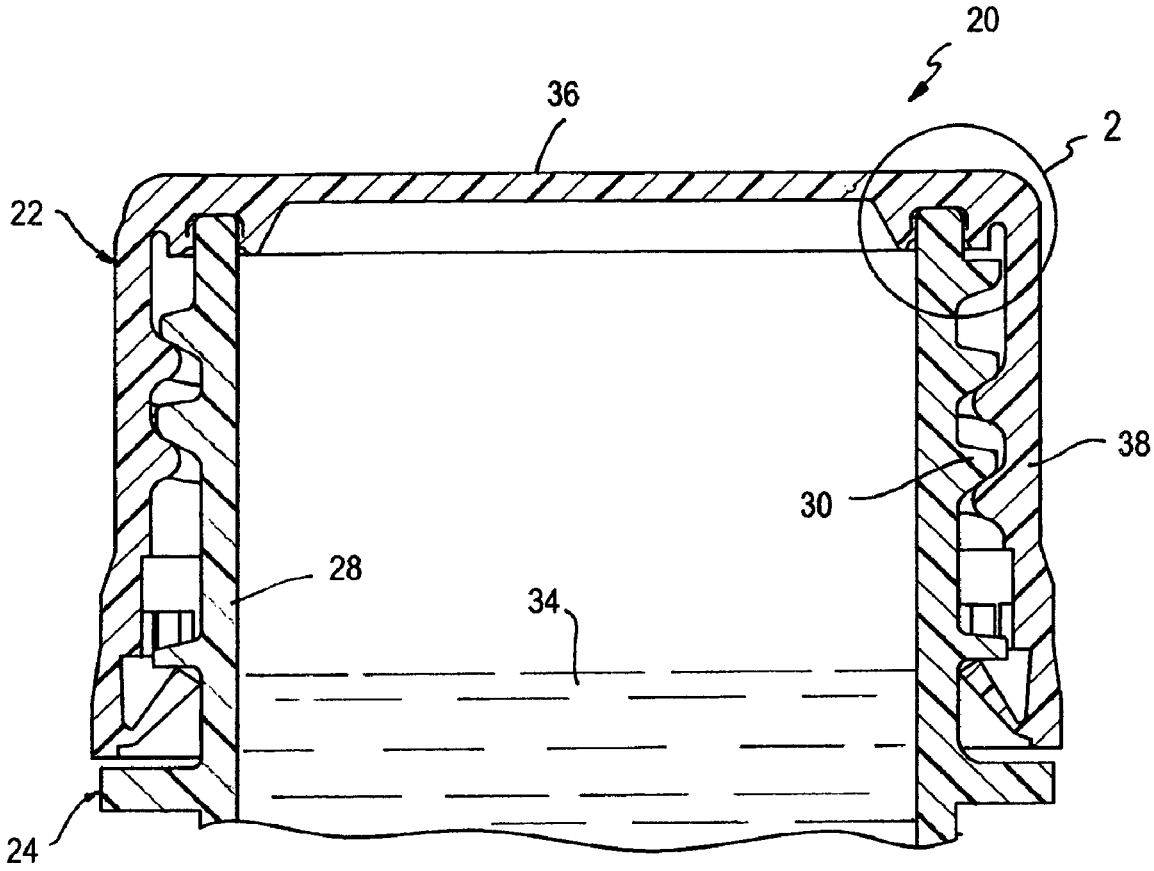
FIG. 1 is a fragmentary sectional view of a package in accordance with one exemplary embodiment of the disclosure.

FIG. 1 illustrates a package 20 in accordance with an exemplary embodiment of the present disclosure. Package 20 includes a closure 22 applied to a container 24. Container 24 has a body from which a cylindrical neck finish 28 extends, typically although not necessarily coaxially with the container body. Neck finish 28 includes an end forming an open mouth with inner and outer cylindrical surfaces that nominally are concentric with each other. One or more external thread segments 30 are provided on neck finish 28 at a position spaced from the mouth of the neck finish. There may or may not be cooperating tamper-indicating structure on the closure and container, of which one type is illustrated in FIG. 1. Package 20 is filled with product 34 and has an internal pressure of at least 10 psi at room temperature.

Figure 4:
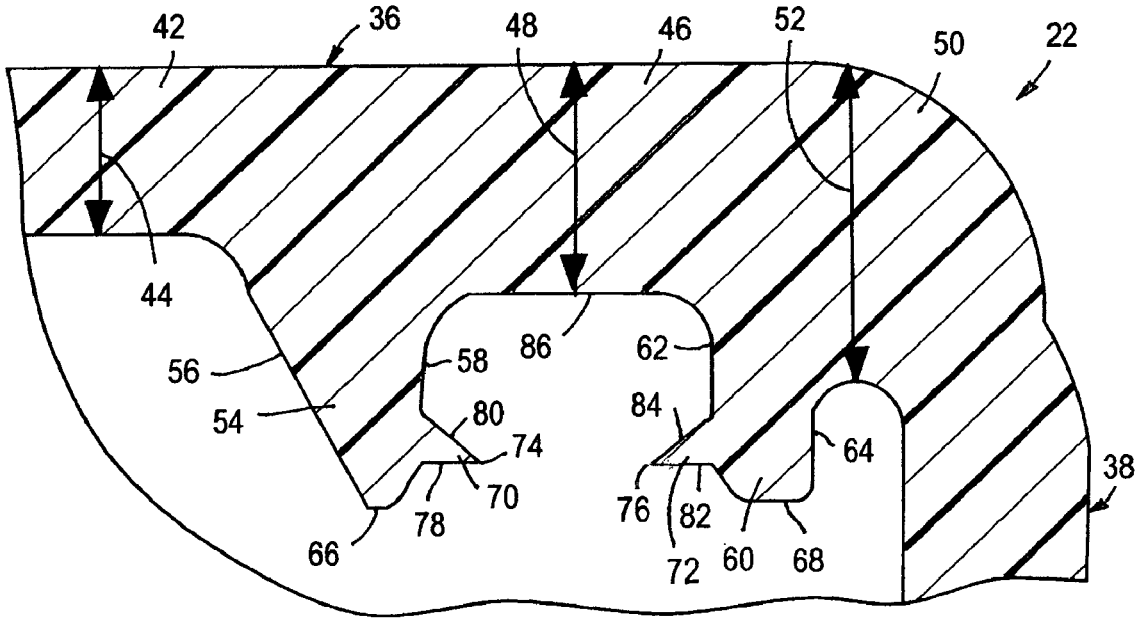
FIG. 4 is a sectional view on an enlarged scale of the portion of FIG. 3 within the area 4.

Referring to FIGS. 1-4, closure 22 includes a base wall 36 and a peripheral skirt 38. Peripheral skirt 38 is cylindrical and has one or more internal thread segments 40 for engagement with external thread segments 30 (FIG. 1) on container neck finish 28. Base wall 36 preferably has a central portion 42 with a first axial thickness 44 (FIG. 4). (Directional words such as "axial" and "radial" are employed by way of description and not limitation with respect to the central axis of container neck finish 28 or closure skirt 38 as appropriate. Directional words such as "upper" and "lower" are employed by way of description and not limitation with respect to the upright orientations of the package and closure illustrated in the drawings.) A first annular peripheral portion 46 of base wall 36 is contiguous with central portion 42 and preferably has a second axial thickness 48 that is greater than thickness 44 of central portion 42. A second annular peripheral portion 50 of base wall 36 integrally connects first peripheral portion 46 with skirt 38, and preferably has an axial thickness 52 that is greater than thickness 48 of first peripheral portion 46. The upper or outer surface of base wall 36 preferably, but not necessarily, is smooth without undulations or recesses.

A first annular wall 54 extends from the juncture of base wall central portion 42 and first peripheral portion 46. In the embodiment of FIGS. 1-4 (and the embodiment of FIG. 5), first annular wall 54 preferably extends at an angle axially away from base wall 36 and radially toward skirt 38. (It will be recognized that all geometries and dimensions provided in this disclosure are nominal geometries and dimensions of the closure as designed. In actual practice these geometries and dimensions may vary somewhat due to tolerance variations in the mold in which the closure is fabricated, and/or due to distortions in the closure geometry as the closure is stripped from the mold.) First annular wall 54 preferably has a radially inwardly facing surface 56 that is nominally conical in geometry, extending axially away from base wall 36 and radially toward skirt 38. By way of example only, surface 56 may be at a nominal angle of 30° to the axis of closure skirt 38. The radially outwardly facing surface 58 of first wall 54 preferably is cylindrical and nominally coaxial with skirt 38. A second annular wall 60 extends away from base wall 36 from a juncture of first and second peripheral base wall portions 46, 50. Second annular wall 60 preferably has a radially inwardly facing surface 62 and a radially outwardly facing surface 64, both of which are nominally cylindrical, coaxial with each other and coaxial with skirt 38. Annular walls 54, 60 are circumferentially continuous. Annular walls 54, 60 preferably have respective ends 66, 68 spaced from base wall 36 and lying in a plane nominally perpendicular to the axis of skirt 38. Wall ends 66,68 preferably are flat.

Figure 2:
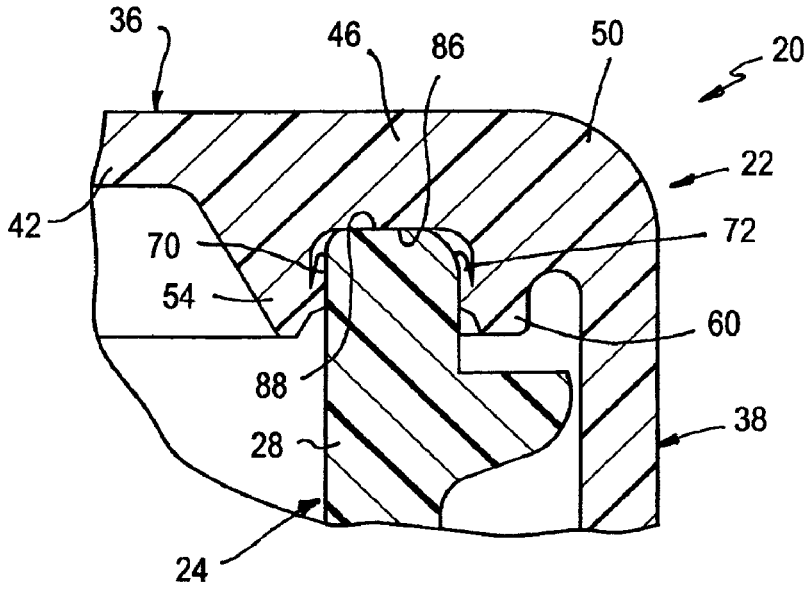
FIG. 2 is a sectional view on an enlarged scale of the portion of FIG. 1 within the area 2.
Figure 3:
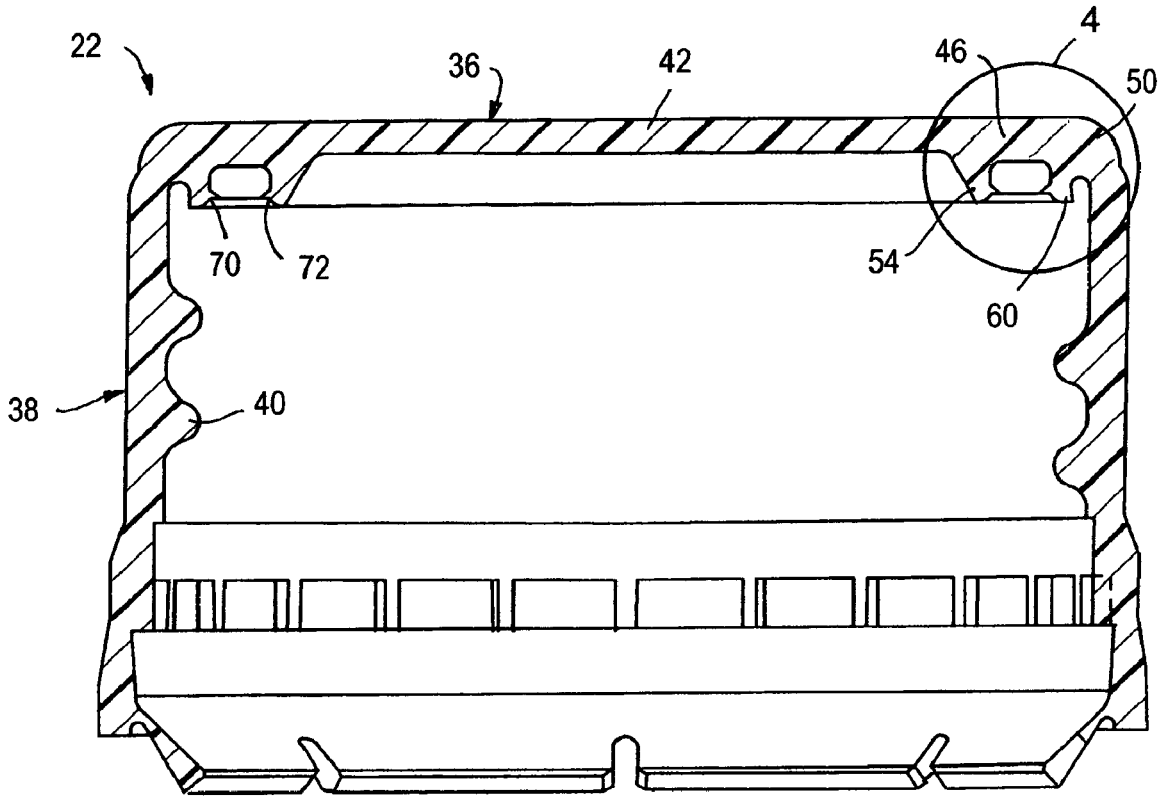
FIG. 3 is a diametric sectional view of the closure in FIG. 1.

A pair of flexible lips or projections 70, 72 extend from first and second annular walls 54, 60. Projections 70, 72 are circumferentially continuous, and preferably are radially opposed to each other, although axially offset projections can be employed if desired. Projections 70, 72 preferably are nominally wedge-shaped in radial cross section, and have respective sharp edges 74, 76 that are radially opposed to each other in a plane nominally perpendicular to the axis of skirt 38. In the embodiment of FIGS. 1-4, projections 70, 72 are mirror images of each other in radial cross section. Projection 70 has an annular undersurface 78 facing away from base wall 36 and an annular upper surface 80 facing in the direction of base wall 36. Likewise, projection 72 has an annular undersurface 82 facing away from base wall 36 and an annular upper surface 84 facing in the direction of base wall 36. Undersurfaces 78, 82, as designed, nominally are flat and coplanar with each other in a plane perpendicular to the axis of skirt 38. Flat annular undersurfaces 78, 82 contribute to the flexibility of projections 70, 72 to ensure that the projections will fold into sealing engagement with the container neck finish (FIG. 2). Upper surfaces 80, 84 preferably are conical and at respective angles to undersurfaces 78, 82, most preferably identical angles in the embodiment of FIGS. 1-4. Upper surfaces 80, 84 are at nominal angles of 35° to undersurfaces 78, 82 in the embodiment of FIGS. 1-4.

When closure 22 is applied to container neck finish 28, projections 70, 72 respectively engage the inside and outside surfaces of the neck finish around the container mouth. Projections 70, 72 are bent and folded upwardly along the respective neck finish surfaces as illustrated in FIG. 2. Closure 22 preferably is tightened onto neck finish 28 sufficiently to bring the axially facing undersurface 86 of base wall portion 46, between annular walls 54, 60, into opposed sealing engagement with the axially facing surface 88 of neck finish 28. Thus, neck finish 28 is sealed by engagement not only with end surface 88, but also by engagement of projections 70, 72 with the inside and outside surfaces of the neck finish around the container mouth. Annular undersurface 86, which extends between walls 54, 60, preferably nominally is flat and perpendicular to the axis of the closure skirt.

Figure 5:
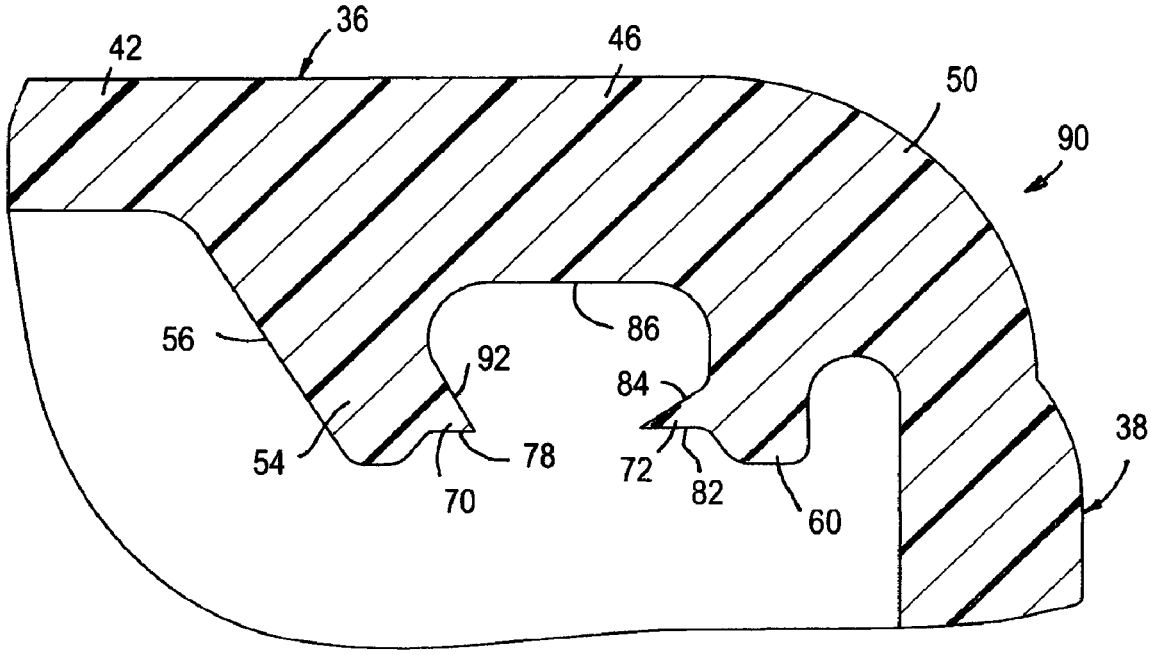
FIGS. 5 and 6 are fragmentary sectional views that are similar to FIG. 4 but illustrate respective alternative embodiments of the disclosure.
Figure 6:
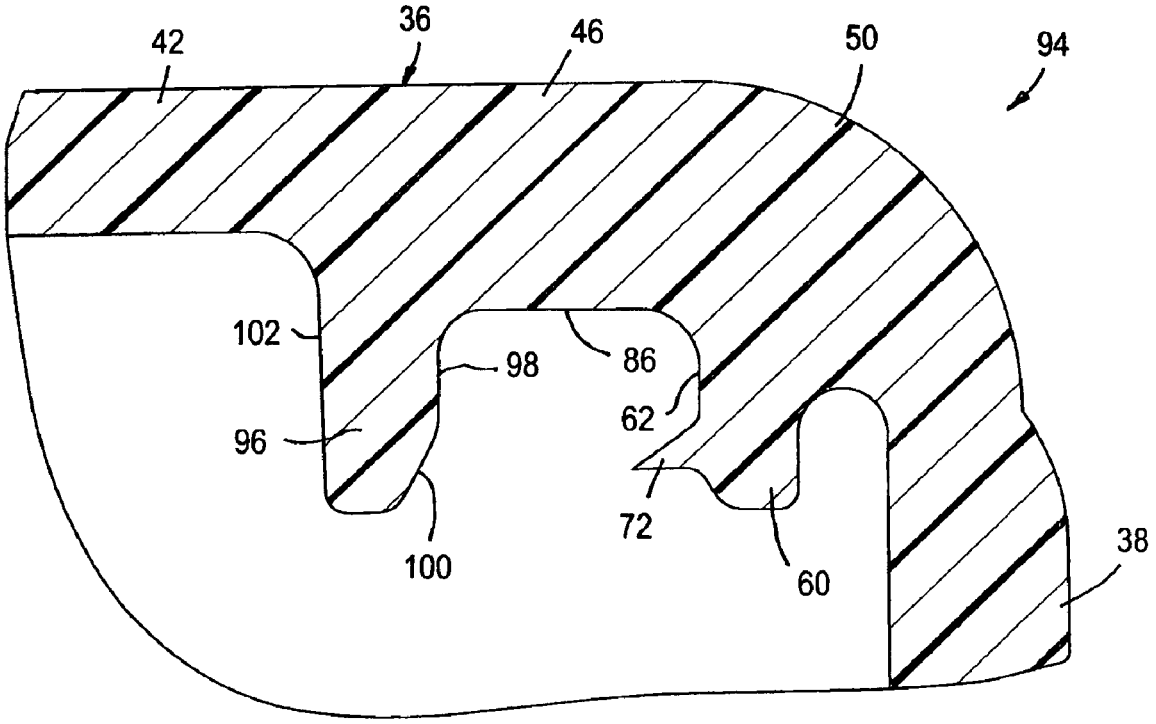

FIGS. 5 and 6 illustrate respective modified embodiments of the disclosure. Reference numerals employed in FIGS. 5 and 6 that are identical to those employed in FIGS. 1-4 indicate correspondingly identical or related components.

The closure 90 in FIG. 5 differs from closure 22 in FIGS. 1-4 primarily in that the upper surface 92 of projection 70 is at a greater angle to undersurface 78 than is upper surface 84 of projection 72. Projections 70, 72 thus are not mirror images of each other in the embodiment of FIG. 5. The angle of surface 92 to surface 78 in FIG. 5 preferably is such that surface 92 nominally is parallel to surface 56. In the embodiment of FIG. 5, projection 70 is stiffer than projection 72, and the closure is easier to strip from the forming mold.

FIG. 6 illustrates a closure 94 in which the first annular wall 96 is nominally cylindrical, rather than angled to base wall 36 as in the embodiments of FIGS. 1-5. Cylindrical annular wall 96 is circumferentially continuous and extends from the juncture of base wall portions 42,46 as in the embodiments of FIGS. 1-5, but nominally is coaxial with and parallel to skirt 38. Annular wall 96 has a radially outer surface with a cylindrical surface portion 98 adjacent to base wall 36 and an inwardly sloping conical surface portion 100 remote from base wall 36. Wall surface portion 98 preferably is nominally cylindrical, coaxial with skirt 38 and coaxial with inner cylindrical surface 102 of wall 96. Projection 72 on annular wall 60 preferably is in radially outward alignment with conical surface portion 100 of wall 96. When closure 94 is applied to a container neck finish, wall 96 is brought into surface-to-surface plug-sealing engagement with the inside surface of the container neck finish, while projection 72 on wall 60 folds upwardly and outwardly in resilient sealing engagement with the outer surface of the container neck finish as in the prior embodiments. The embodiment of FIG. 6 is easily stripped from its forming mold.

The closure of the present disclosure may be molded of any suitable plastic material such as polypropylene. Container 24 is illustrated as being of plastic construction in FIGS. 1 and 2, which is preferred, but could be of other suitable construction such as glass.

There thus have been disclosed a closure and package that fully satisfy all of the objects and aims previously set forth. The closure of the present disclosure is able to maintain sealing engagement with the container neck finish of a pressurized package under a wide variety of conditions and environments. The disclosure has been presented in conjunction with several presently preferred embodiments, and a number of modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A linerless closure of one-piece integrally molded plastic construction, which includes:

a base wall and a cylindrical skirt for attaching the closure to a container neck finish, said base wall having a central portion with a first thickness, a first peripheral portion contiguous with said central portion and having a second thickness greater than said first thickness, and a second peripheral portion connecting said first peripheral portion and said skirt and having a third thickness greater than said second thickness, a first circumferentially continuous annular wall extending away from said base wall at a juncture of said central and first peripheral portions of said base wall, a second circumferentially continuous annular wall extending away from said base wall at a juncture of said first and second peripheral portions of said base wall, said first and second annular walls being spaced from each other to receive therebetween an end portion of the container neck finish when the closure is attached to the container neck finish, at least one of said annular walls having a circumferentially continuous annular projection extending toward the opposing annular wall, said annular projection being axially flexible with respect to said at least one annular wall for bending and folding toward said base wall and toward said at least one annular wall upon engagement with the container neck finish end portion, said at least one annular projection including an undersurface facing away from said base wall to contribute to the flexibility of said at least one annular projection to ensure that said at least one annular projection will fold into sealing engagement with an outside cylindrical surface of the container neck finish, wherein said first peripheral portion of said closure base wall has an undersurface between said first and second annular walls, and wherein said closure is sealingly engageable with the container neck finish by engagement of said closure base wall undersurface with an end surface of the container neck finish and by engagement of said at least one annular projection undersurface with an outside cylindrical surface of the container neck finish.

2. The closure set forth in claim 1 wherein both of said annular walls have circumferentially continuous annular axially flexible projections extending toward the opposing annular wall.

3. The closure set forth in claim 2 wherein said annular projections are radially opposed to each other.

4. The closure set forth in claim 3 wherein said annular projections are mirror images of each other in radial cross section.

5. The closure set forth in claim 1 wherein said first and second annular walls have ends spaced from said base wall and coplanar with each other in a plane perpendicular to a central axis of said cylindrical skirt.

6. The closure set forth in claim 1 wherein said first annular wall extends at an angle axially away from said base wall and radially toward said skirt, and wherein said second annular wall extends axially away from said base wall.

7. The closure set forth in claim 1 wherein said first annular wall extends axially away from said base wall, said first annular wall having a radially outer surface with a cylindrical surface portion adjacent to said base wall and an inwardly conical surface portion remote from said base wall, and wherein said second annular wall extends axially away from said base wall, said second annular wall having said circumferentially continuous annular projection extending radially inwardly toward said first annular wall in radially opposed alignment with said conical surface portion of said first annular wall, and said first annular wall being in plug-sealing engagement with an inside cylindrical surface of the container neck finish and said annular projection undersurface being in sealing engagement with the outside cylindrical surface of the container neck finish.

8. The closure set forth in claim 1 wherein said annular projection undersurface is flat and perpendicular to a central axis of said cylindrical skirt.

9. The closure set forth in claim 8 wherein said at least one annular projection includes a conical upper surface at an angle to said annular projection undersurface.

10. A package that includes:

a container having a cylindrical neck finish with an open end, inner and outer side cylindrical surfaces adjacent to said open end, and at least one external thread segment, and a linerless closure of one-piece integrally molded plastic construction, which includes:

a base wall and a cylindrical skirt with at least one internal thread segment engaged with said external thread segment and attaching said closure to said container neck finish, first and second circumferentially continuous annular walls extending from said base wall at positions radially inward from said skirt, said first and second annular walls being spaced from each other and receiving an end portion of said container neck finish, at least one of said annular walls having a circumferentially continuous annular projection engaged with a side cylindrical surface of said container neck finish and being folded toward said base wall and toward said at least one annular wall to seal said package, said annular projection including an undersurface facing away from said base wall to contribute to the flexibility of said annular projection to ensure that said annular projection will fold into sealing engagement with said container neck finish, said closure being secured to said container neck finish and said package having an internal pressure of at least ten pounds per square inch at room temperature, wherein said base wall has a flat axially facing surface extending between said first and second annular walls, from said front annular wall to said second annular wall, in opposed sealing engagement with an end surface of said container neck finish, and wherein said package is sealed by engagement of said closure base wall flat axially facing surface with said container neck finish end surface and by engagement of said annular projection undersurface with said container neck finish side cylindrical surface wherein said base wall has a central portion with a first thickness, a first peripheral portion contiguous with said central portion and having a second thickness greater than said first thickness, and a second peripheral portion between said first peripheral portion and said skirt and having a third thickness greater than said second thickness, wherein said first of said annular walls extends at an angle axially away from said base wall and radially toward said skirt at a juncture of said central and first peripheral portions of said base wall, wherein said second annular wall extends axially away from said base wall at a juncture of said first and second peripheral portions of said base wall, and wherein both of said annular walls have circumferentially continuous annular projections engaged with opposing side cylindrical surfaces of said container neck finish and being folded toward said base wall and toward said annular walls to seal said package.

11. The package set forth in claim 10 wherein said annular projection undersurface of said closure is flat and perpendicular to a central axis of said cylindrical skirt.

12. The closure set forth in claim 11 wherein said at least one annular projection includes a conical upper surface at an angle to said annular projection undersurface.

13. A package that includes:

a container having a cylindrical neck finish with an open end, inner and outer side cylindrical surfaces adjacent to said open end, and at least one external thread segment, and a linerless closure of one-piece integrally molded plastic construction, which includes:

a base wall and a cylindrical skirt for attaching the closure to said container neck finish, said base wall having a central portion with a first thickness, a first peripheral portion contiguous with said central portion and having a second thickness greater than said first thickness, and a second peripheral portion connecting said first peripheral portion and said skirt and having a third thickness greater than said second thickness, a first circumferentially continuous annular wall extending away from said base wall at a juncture of said central and first peripheral portions of said base wall, a second circumferentially continuous annular wall extending away from said base wall at a juncture of said first and second peripheral portions of said base wall, said first and second annular walls being spaced from each other to receive an end portion of said container neck finish when the closure is attached to said container neck finish, at least one of said annular walls having a circumferentially continuous annular projection extending toward the opposing annular wall, said annular projection being engaged with an opposing one of said side cylindrical surfaces of said container neck finish and folded toward said base wall and toward said at least one annular wall to seal said package, said annular projection including an undersurface facing away from said base wall to contribute to the flexibility of said annular projection to ensure that said annular projection will fold into sealing engagement with said container neck finish, said first peripheral portion of said closure base wall having an undersurface between said first and second annular walls, and wherein said package is sealed by engagement of said closure base wall undersurface with an end surface of said container neck finish and by engagement of said annular projection undersurface with said opposing side cylindrical surface.

14. The package set forth in claim 13 wherein said base wall undersurface has a flat axially facing surface extending between said first and second annular walls, from said first annular wall to said second annular wall, in opposed sealing engagement with said end surface of said container neck finish.

15. The package set forth in claim 13 wherein said first of said annular walls extends at an angle axially away from said base wall and radially toward said skirt at a juncture of said central and first peripheral portions of said base wall, wherein said second annular wall extends axially away from said base wall at a juncture of said first and second peripheral portions of said base wall, and wherein both of said annular walls have circumferentially continuous annular projections engaged with opposing side cylindrical surfaces of said container neck finish and being folded toward said base wall and toward said annular walls to seal said package.

16. The package set forth in claim 13 wherein said first annular wall extends axially away from said base wall at a juncture of said central and first peripheral portions of said base wall, said first annular wall having a radially outer surface with a cylindrical surface portion adjacent to said base wall and an inwardly conical surface portion remote from said base wall, wherein said second annular wall extends axially away from said base wall at a juncture of said first and second peripheral portions of said base wall, said second annular wall having said circumferentially continuous annular projection extending radially inwardly toward said first annular wall in radially opposed alignment with said conical surface portion of said first annular wall, said annular projection being axially flexible and being bent and folded toward said base wall and toward said second annular wall by engagement with said end portion of said container neck finish, and said first annular wall being in plug-sealing engagement with an inside cylindrical surface of said container neck finish and said annular projection undersurface being in sealing engagement with an outside cylindrical surface of said container neck finish.

17. The package set forth in claim 13 wherein said annular projection undersurface of said closure is flat and perpendicular to a central axis of said cylindrical skirt.

18. The closure set forth in claim 17 wherein said at least one annular projection includes a conical upper surface at an angle to said annular projection undersurface.

19. A package that includes:

a container having a cylindrical neck finish with an open end, inner and outer side cylindrical surfaces adjacent to said open end, and at least one external thread segment, and a linerless closure of one-piece integrally molded plastic construction, which includes:

a base wall and a cylindrical skirt with at least one internal thread segment engaged with said external thread segment and attaching said closure to said container neck finish, first and second circumferentially continuous annular walls extending from said base wall at positions radially inward from said skirt, said first and second annular walls being spaced from each other and receiving an end portion of said container neck finish, at least one of said annular walls having a circumferentially continuous annular projection engaged with a side cylindrical surface of said container neck finish and being folded toward said base wall and toward said at least one annular wall to seal said package, said annular projection including an undersurface facing away from said base wall to contribute to the flexibility of said annular projection to ensure that said annular projection will fold into sealing engagement with said container neck finish, said closure being secured to said container neck finish and said package having an internal pressure of at least ten pounds per square inch at room temperature, wherein said base wall has a flat axially facing surface extending between said first and second annular walls, from said front annular wall to said second annular wall, in opposed sealing engagement with an end surface of said container neck finish, wherein said package is sealed by engagement of said closure base wall flat axially facing surface with said container neck finish end surface and by engagement of said annular projection undersurface with said container neck finish side cylindrical surface, wherein said base wall has a central portion with a first thickness, a first peripheral portion contiguous with said central portion and having a second thickness greater than said first thickness, and a second peripheral portion between said first peripheral portion and said skirt and having a third thickness greater than said second thickness, wherein said first annular wall extends axially away from said base wall at a juncture of said central and first peripheral portions of said base wall, said first annular wall having a radially outer surface with a cylindrical surface portion adjacent to said base wall and an inwardly conical surface portion remote from said base wall, wherein said second annular wall extends axially away from said base wall at a juncture of said first and second peripheral portions of said base wall, said second annular wall having said circumferentially continuous annular projection extending radially inwardly toward said first annular wall in radially opposed alignment with said conical surface portion of said first annular wall, said annular projection being axially flexible and being bent and folded toward said base wall and toward said second annular wall by engagement with said end portion of said container neck finish, and said first annular wall being in plug-sealing engagement with an inside cylindrical surface of said container neck finish and said annular projection being in sealing engagement with an outside cylindrical surface of said container neck finish.

* * * * *